United States Patent [19]

La Breche

[11] 4,082,286

[45] Apr. 4, 1978

[54] DIRECTION AND SLOPE INDICATING PUTTER HEAD

[76] Inventor: Ferdinand J. La Breche, 412 Burchett St., Glendale, Calif. 91203

[21] Appl. No.: 710,821

[22] Filed: Aug. 2, 1976

[51] Int. Cl.[2] ..... A63B 69/36

[52] U.S. Cl. ..... 273/162 B; 273/32 H; 273/183 D; 273/162 F

[58] Field of Search ..... 273/162 B, 32 H, 162 R, 273/163 R, 163 A, 164, 183 D, 162 F

[56] References Cited

U.S. PATENT DOCUMENTS

| | | | |
|---|---|---|---|
| 2,919,922 | 1/1960 | Skelly | 273/162 B |
| 2,976,046 | 3/1961 | McCullough | 273/162 B |
| 3,306,618 | 2/1967 | Liljequist | 273/162 B |
| 3,679,206 | 7/1972 | Shambaugh | 273/32 H |
| 3,751,819 | 8/1973 | Dixon | 273/32 H |

*Primary Examiner*—George J. Marlo
*Attorney, Agent, or Firm*—Warren T. Jessup

[57] ABSTRACT

A putter for indicating the slope and direction in which a golf ball should be stroked in which the putter head includes a level observable during use of the club and a device for indicating the amount of offset at which the putt should be stroked in order to direct the ball toward the cup. The putter also includes a measuring device in the handle for measuring the exact offset. The head may be provided in various sizes and shapes with the offset indicator expanded according to the amount of area provided.

4 Claims, 5 Drawing Figures

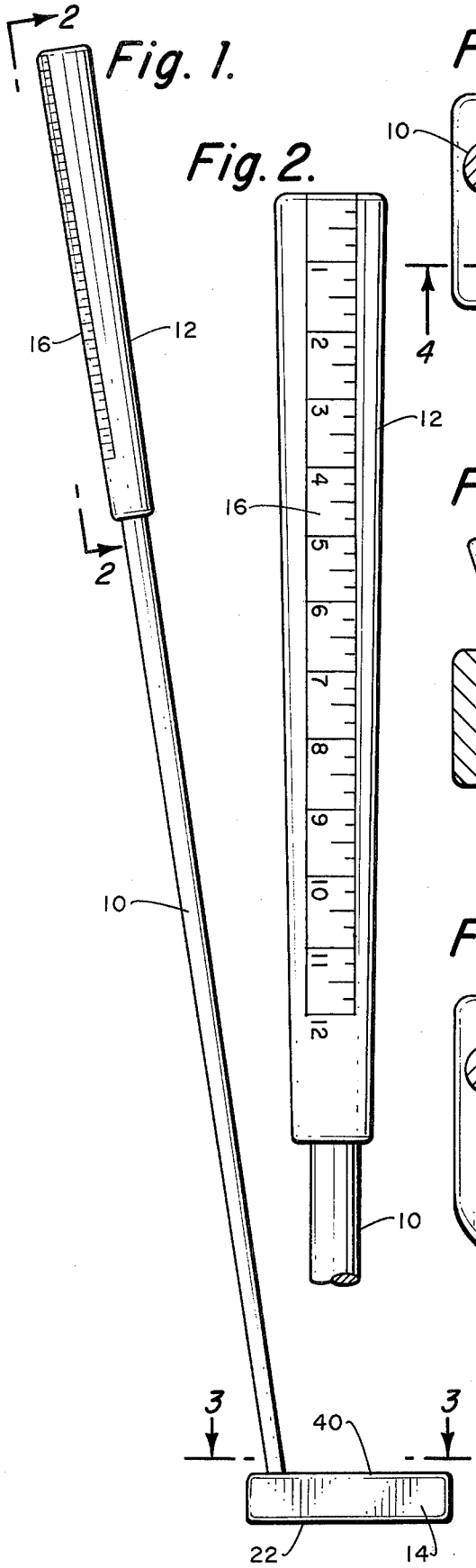
Fig. 1.
Fig. 2.
2
2
16
12
16
12
10
10
3
3
40
22
14
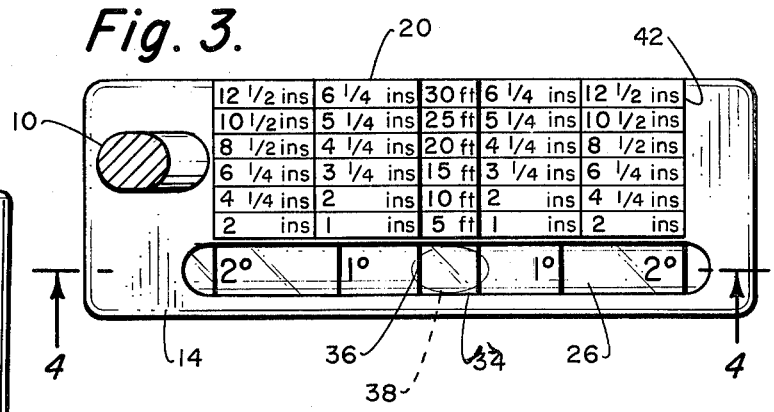
Fig. 3.
20
42
10
12 1/2 ins | 6 1/4 ins | 30 ft | 6 1/4 ins | 12 1/2 ins
10 1/2 ins | 5 1/4 ins | 25 ft | 5 1/4 ins | 10 1/2 ins
8 1/2 ins | 4 1/4 ins | 20 ft | 4 1/4 ins | 8 1/2 ins
6 1/4 ins | 3 1/4 ins | 15 ft | 3 1/4 ins | 6 1/4 ins
4 1/4 ins | 2 ins | 10 ft | 2 ins | 4 1/4 ins
2 ins | 1 ins | 5 ft | 1 ins | 2 ins
2° 1° 1° 2°
4
4
14
36
38
34
26
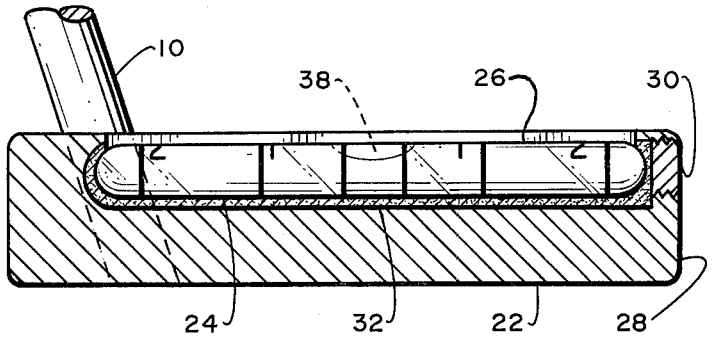
Fig. 4.
10
38
26
30
24
32
22
28
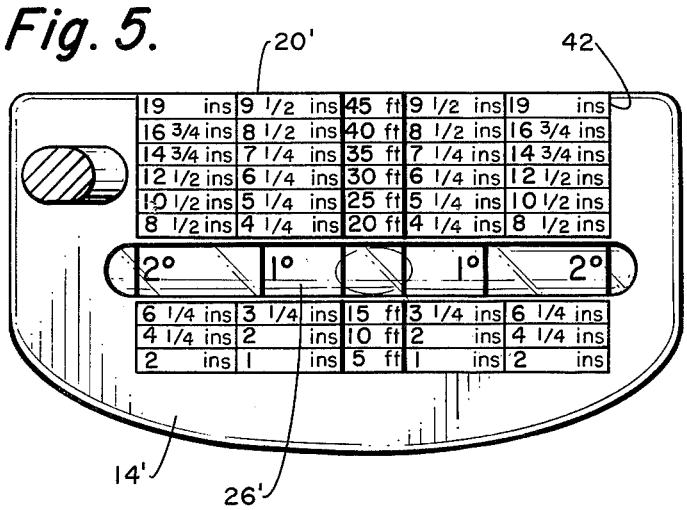
Fig. 5.
20'
42
19 ins | 9 1/2 ins | 45 ft | 9 1/2 ins | 19 ins
16 3/4 ins | 8 1/2 ins | 40 ft | 8 1/2 ins | 16 3/4 ins
14 3/4 ins | 7 1/4 ins | 35 ft | 7 1/4 ins | 14 3/4 ins
12 1/2 ins | 6 1/4 ins | 30 ft | 6 1/4 ins | 12 1/2 ins
10 1/2 ins | 5 1/4 ins | 25 ft | 5 1/4 ins | 10 1/2 ins
8 1/2 ins | 4 1/4 ins | 20 ft | 4 1/4 ins | 8 1/2 ins
2° 1° 1° 2°
6 1/4 ins | 3 1/4 ins | 15 ft | 3 1/4 ins | 6 1/4 ins
4 1/4 ins | 2 ins | 10 ft | 2 ins | 4 1/4 ins
2 ins | 1 ins | 5 ft | 1 ins | 2 ins
14'
26'

DIRECTION AND SLOPE INDICATING PUTTER HEAD

BACKGROUND

This invention relates to golf clubs generally and also relates particularly to putters including means for measuring and determining the slope of a green and the direction in which a putt should be stroked.

In the game of golf it is customary for a player when he reaches the green to try to determine the slope of the green in order to determine the direction in which a putt should be stroked to put the ball in the cup or bring it very close to the cup. It is not only important to know whether the green slopes toward the cup or the right or left of the cup but also to know the approximate slope in order to gauge the offset in stroking the ball. For this reason there have been disclosed putters which include levels to measure the slope giving some indication of the direction at which the green slopes. That is, whether the green slopes at an angle to the right or left or slopes downward toward the cup.

However, previous devices though they gave some indication of the slope of the green provided no means by which the putter could determine how far he should stroke the ball from a direct line to the hole in order to put it in the hole or come close to it. The present invention solves this problem by not only providing an indication of the slope which can be easily read while the putting stroke is being practiced but also includes an indicator to determine how far the putt should be stroked from a direct line to the hole (i.e. the offset).

SUMMARY

The purpose of the present invention is to provide a putter which indicates the direction, and slope of a green in order to increase accuracy when putting a golf ball.

In the present invention a level in the putter head provides an indication of the slope of the green as well as indicating whether the person using the club is holding the club substantially level during the stroke. In addition to the level, which may be suitably padded to prevent breaking in the case where glass is used, an indicating device is applied to the putter head to provide an approximate measure of the direction at which the putt should be stroked. The calibrated scale indicates the amount of offset from a direct line to the hole at which the putt should be stroked in order to afford the putt at that distance to enter the hole. That is, for a putt of 20 ft. on a green having a slope of approximately 1° to the left of a straight line to the hole the putt should be stroked approximately 4¼ inches offset to the left of the hole. The opposite of course would be true of a putt which has a 1° slope to the right of the hole. The indicator is calibrated in distance and degrees to indicate the amount of offset for putts of various lengths. In order to accurately determine the amount of offset a scale is built into the handle of the putter so that the person making the putt can estimate accurately just how far an offset of 2 to 12 inches may be. Thus the present invention provides a dual purpose putter solving the problems of previous inventions by providing an indication of a level stroke which is required and also indicating the slope of the green and the direction in which a putt should be stroked.

It is one object of the present invention to provide a putter which indicates a slope of the green.

Another object of the present invention is to provide a putter which, in addition to providing the slope of the green provides an indication of the direction in which the putt should be stroked.

Yet another object of the present invention is to provide a putter which indicates when the stroke is substantially level.

Still another object of the present invention is to provide a putter which provides a built-in scale for measuring short distances.

Other objects, advantages and novel features will become apparent from the following detailed description of the invention when considered in conjunction with the accompanying drawings wherein like reference nos. identify like parts throughout.

FIG. 1 is a side elevation of the putter of the invention.

FIG. 2 is a detail view of the handle of the putter taken at 2—2 of FIG. 1.

FIG. 3 is a view of the putter head taken at 3—3 of FIG. 1.

FIG. 4 is a sectional side elevation taken at 4—4 of FIG. 3.

FIG. 5 is a view of a variation of the putter head of FIG. 3.

DESCRIPTION OF THE PREFERRED EMBODIMENT

The putter illustrated in FIG. 1 is comprised of an elongate shaft 10 having a handle 12 at one end and a head 14 at the opposite end. The handle 12 may be any one of a number of materials such as leather or rubber commonly used with such golf clubs.

In order to provide a measuring device for various purposes a scale 16 is embedded in the handle 12. Alternatively, the scale 16 could be imprinted on the handle or applied by a decal if desired. The former method of imbedding in the handle is preferred because it is permanent. The scale 16 could be made of any suitable plastic, wood or any other material and covered over with a protective plastic cover if desired.

The head portion 14 of the club is shown in detail in FIG. 3. This part of the club is provided with a face 20 perpendicular to the bottom of the club 22 and having its plane substantially parallel with the axis of the shaft. The head 14 is provided with a cavity 24 in which a leveling bulb 26 is mounted. The level is inserted through the toe 28 of the club head 14 and then is closed with a removable threaded plug 30 which may be sealed with a weld or remain threaded for removal and replacement of the level 26 if desired.

If the level 26 is made of a glass material a suitable padding 32 would be provided to prevent breakage of the level. This material would be selected from a rubber or plastic material which would provide suitable protection from breakage while firmly holding the level in position. The level 26 would be mounted with the center portion 34 aligned approximately with the center of the stroking face 20.

The level 26 is provided with markings 36 to indicate a level position, a 1° position and a 2° position of the bubble 38 for indicating the slope of a green.

The top 40 of the putter head 14 is provided with a calibrated indicator 42 for determining the amount of offset at which the putt should be stroked in accordance with the length of the putt and the slope of the green. The indicator 42 is arranged with distance increments in the center and the amount of offset aligned with each respective degree marking. Thus the indicator 42 (FIG. 3) shows the amount of offset for distances of 5 to 30 ft. in increments of 5 ft. This scale was chosen for convenience but could be expanded in a number of ways.

For example the head could be expanded to the mallet style head 14' illustrated in FIG. 5. In this figure the putting face is shown at 20' with the level 26' being shown in substantially the same position with the putter head 14 being expanded beyond the level 26'. This would permit an expanded scale for the distances up to 45 ft. and perhaps more depending upon the size of the putter head. It is preferable to make the indicator 42 large enough to be read by the putter without having to bring the putter off the surface of the green.

In use the putter head 14 or 14' would be placed adjacent to the ball to be stroked and the angle of the slope read by the position of the bubble 38 in the level 26. The scale on the indicator 42 determined from the approximate footage of the putt (which can be measured by walking it off) would then give the amount of offset for that particular putt. For example, if the putt were at a 2° slope to the right or left at a distance of 25 feet, then the putt would be stroked approximately 10½ inches to the right or the left of a straight line drawn between the ball and the cup.

If the player wanted to obtain a reasonably accurate indication of just how far an offset of 10½ inches is he would use the scale on the putter handle 12 as shown in FIG. 2 to measure from the center of the cup left or right 10½ inches perpendicular to the straight line direction between the ball and the cup. He can then place a marker to the right or left of the cup at the necessary 10½ inches offset from a straight line. His accuracy will be improved by stroking the ball toward the spot marked. This would obviously increase accuracy by reducing the number of considerations during stroking of the putt to just that of the distance keeping in mind the spot chosen for directing the putt towards. The amount of increase in accuracy would depend upon how careful each putter is in his use of the device.

Thus there has been described a novel direction and slope indicating putter capable of increasing the accuracy of putts while providing a dual purpose putting tool. There are obviously many variations which can be incorporated such as lengthening the head to increase the scale or using a curved level to indicate greater degrees of slope as well as providing more or less sensitivity to slope. These variations are only limited by the necessity of keeping the putter head to a reasonable size. Of course for those who are lefthanded the putter head would be the reverse of that shown in FIG. 3.

Obviously, many modifications and variations of the present invention are possible in the light of the above teachings. It is therefore understood that the full scope of the invention is not limited to the details disclosed herein and may be practiced otherwise than as specifically described.

What is claimed is:

1. A putter for indicating the slope, level and angle at which a putt should be stroked toward a golf hole comprising:

an elongate shaft;

a handle on one end of said shaft;

an offset head on the opposite end of said elongate shaft from said handle;

said head being attached to said shaft and having a planar perpendicular surface for striking a ball;

an elongate levelling bulb in the uppermost surface of said head;

the axis of said bulb being substantially parallel with said planar surface;

indicating means on said head correlated with said levelling bulb for directly reading the direction toward which a ball should be struck with respect to the hole;

said indicating means comprising a table having a column of distance from the hole increments and a separate column for each respective degree marking; said separate columns having numbers representing the amount of offset from the center of the hole at which to strike the ball for each respective distance from the hole increment, whereby the amount of offset to the right or left of the hole at which to strike the ball may be determined from the position of the bubble in said levelling bulb.

2. The level and direction indicating putter according to claim 1 wherein said handle includes measuring means for measuring the offset direction indicated by said indicating means.

3. The level and direction indicating putter according to claim 1 including removably threaded plug means for removing and replacing said leveling bulb.

4. The level and direction indicating putter according to claim 1 wherein said separate offset columns are calibrated in inches per degree, whereby the ball is stroked toward an imaginary spot to either side of the hole corresponding to the inches read directly from the table.

* * * * *